US010011003B1

(12) United States Patent
Liu

(10) Patent No.: US 10,011,003 B1
(45) Date of Patent: Jul. 3, 2018

(54) PEN VICE

(71) Applicant: Yu-Chun Liu, Taichung (TW)

(72) Inventor: Yu-Chun Liu, Taichung (TW)

( * ) Notice: Subject to any disclaimer, the term of this patent is extended or adjusted under 35 U.S.C. 154(b) by 0 days.

(21) Appl. No.: 15/631,195

(22) Filed: Jun. 23, 2017

(51) Int. Cl.

| | |
|---|---|
| ***B25B 1/00*** | (2006.01) |
| ***B25B 1/10*** | (2006.01) |
| ***B25B 1/24*** | (2006.01) |
| ***B25B 1/20*** | (2006.01) |

(52) U.S. Cl.
CPC ..... *B25B 1/10* (2013.01); *B25B 1/20* (2013.01); *B25B 1/2484* (2013.01); *B25B 1/2489* (2013.01); *B25B 1/00* (2013.01)

(58) Field of Classification Search
CPC .... B25B 1/00; B25B 1/10; B25B 1/14; B25B 5/10; B25B 5/02
See application file for complete search history.

(56) References Cited

U.S. PATENT DOCUMENTS

| | | | | |
|---|---|---|---|---|
| 4,108,589 A * | 8/1978 | Bunch | B21D 19/046 | 269/228 |
| 4,366,606 A * | 1/1983 | Willis | E21B 19/06 | 269/218 |
| 7,789,379 B2 * | 9/2010 | Livingston, Jr. | B25B 5/163 | 269/249 |
| 2006/0049566 A1 * | 3/2006 | Bernstein | B25B 1/103 | 269/43 |

* cited by examiner

*Primary Examiner* — Lee D Wilson
(74) *Attorney, Agent, or Firm* — Egbert Law Offices, PLLC

(57) ABSTRACT

A pen vice includes a base, an operating device mounted onto the base and multiple studs vertically secured on the base, wherein the studs correspond to two opposite sides of the base. Two parallel link mechanisms respectively mounted onto the studs that correspond to the two opposite sides of the base. A first sliding jaw and a second sliding jaw is disposed between the two parallel link mechanisms. The two parallel link mechanisms drive the first sliding jaw and the second sliding jaw to clamp or release a pen shank.

10 Claims, 6 Drawing Sheets

PEN VICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to pen vice, and more particularly to a pen vice that is provided for clamping a shank of the pen during drilling a longitudinally hole in the shank.

2. Description of Related Art Including Information Disclosed Under 37 CFR 1.97 and 37 CFR 1.98

A pen vice is a personal auxiliary device for clamping a pen shank during drilling a longitudinally hole or processing the pen shank.

A conventional pen vice in accordance with the prior art includes a base and quick-release operating device mounted onto the base for driving two sliding jaws to clamp or release the pen shank. The two sliding jaws are simultaneously moved by two parallel link mechanisms, wherein each parallel link mechanisms is mounted onto an outer side of a supporting plate that is secured on the base.

Consequently, the conventional pen vice has a great width, the guiding effect of the parallel link mechanisms is unstable and the supporting plate has a high price due to its complex structure such that the conventional pen vice needs to be advantageously altered.

The present invention has arisen to mitigate and/or obviate the disadvantages of the conventional pen vice.

BRIEF SUMMARY OF THE INVENTION

The main objective of the present invention is to provide an improved pen vice that is provided for clamping a shank of the pen when drilling a longitudinally hole in the shank.

To achieve the objective, the pen vice in accordance with the present invention comprises a base formed with a top surface. An operating device is mounted onto a first end portion of the top surface. The operating device includes a seat secured on the top surface. A shaft is movably mounted onto the seat and an operating element pivotally mounted to the seat for reciprocally driving the shaft, wherein the shaft is formed with a drive end. Multiple studs are vertically secured on a second end portion of the top surface and correspond to two opposite sides of the base. Two parallel link mechanisms are respectively mounted onto the top surface and correspond to the two opposite sides of the base. Each parallel link mechanism includes an upper linkage and a lower linkage, wherein each upper linkage and lower linkage has a front end and a rear end. A front linkage has two opposite ends respectively pivotally connected to a front end of each of the upper linkage and the lower linkage, and a rear linkage has two opposite ends respectively pivotally connected to a rear end of each of the upper linkage and the lower linkage. A middle linkage has two opposite ends respectively pivotally connected to a middle portion of each of the front linkage and the rear linkage, wherein the middle linkage is parallel to the upper linkage and the lower linkage. The middle linkage has an elongated groove longitudinally defined therein. The middle portion of the front linkage and the rear linkage, and two opposite ends of the middle linkage are pivotally mounted to a corresponding one of the multiple studs. Consequently, the pivots are used as a pivot point when the front linkage and the rear linkage are respectively simultaneously swung relative to the corresponding stud, and the upper linkage and the lower linkage are simultaneously moved opposite to each other. A first sliding jaw and a second sliding jaw are disposed between the two parallel link mechanisms and correspond to each other. The first sliding jaw and the second sliding jaw respectively has a notch defined in an inner side thereof. The first sliding jaw has two opposite sides respectively secured to the lower linkage of each of the two parallel link mechanisms by a first locking member. The second sliding jaw has two opposite sides respectively secured to the upper linkage of each of the two parallel link mechanisms by a second locking member. Each side of the first sliding jaw and the second sliding jaw has a guider extending therefrom, wherein each guider extends through the elongated groove in a corresponding one of the two middle linkages for guiding the first sliding jaw and the second sliding jaw when being moved.

Further benefits and advantages of the present invention will become apparent after a careful reading of the detailed description with appropriate reference to the accompanying drawings.

DETAILED DESCRIPTION OF THE INVENTION

Figure 1:
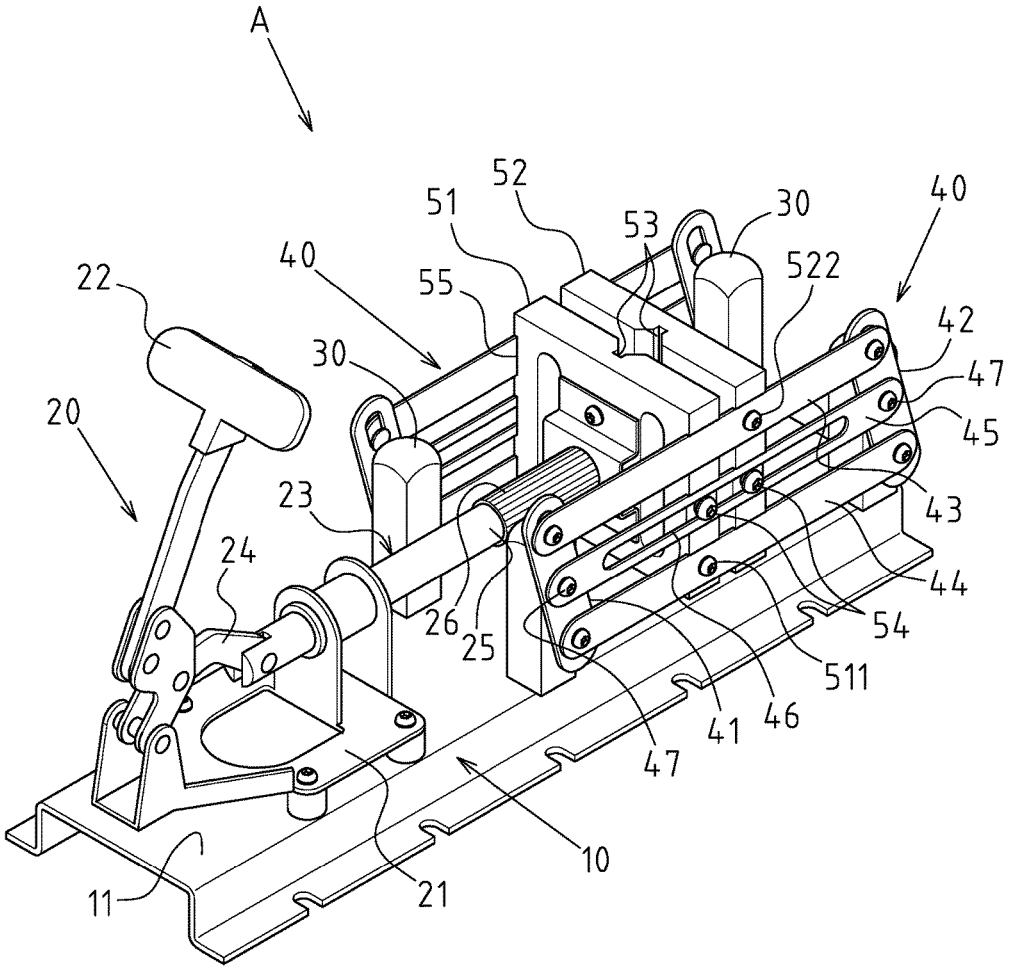
FIG. 1 is a perspective view of a pen vice in accordance with the present invention.

Referring to the drawings and initially to FIGS. 1-4, a pen vice A in accordance with the present invention comprises a base 10 formed with a top surface 11. An operating device 20 is mounted onto a first end portion of the top surface 11. The operating device 20 includes a seat 21 secured on the top surface 11. A shaft 23 is movably mounted onto the seat 21 and an operating element 22 pivotally mounted to the seat 21 for reciprocally driving the shaft 23, wherein the shaft 23 is formed with a drive end 25. Multiple studs 30 are vertically secured on a second end portion of the top surface 11 and correspond to two opposite sides of the base 10. Two parallel link mechanisms 40 are respectively mounted onto the studs 30 that correspond to the two opposite sides of the base 10. Each parallel link mechanism 40 includes an upper linkage 43 and a lower linkage 44, wherein each upper linkage 43 and lower linkage 44 has a front end and a rear end. A front linkage 41 has two opposite ends respectively pivotally connected to a front end of each of the upper linkage 43 and the lower linkage 44, and a rear linkage 42 has two opposite ends respectively pivotally connected to a rear end of each of the upper linkage 43 and the lower linkage 44. A middle linkage 45 has two opposite ends respectively pivotally connected to a middle portion of each of the front linkage 41 and the rear linkage 42, wherein the middle linkage 45 is parallel to the upper linkage 43 and the lower linkage 44. The middle linkage 45 has an elongated groove 46 longitudinally defined therein. The middle portion of the front linkage 41 and the rear linkage 42, and two opposite ends of the middle linkage 45 are pivotally mounted to a corresponding one of the multiple studs 30. Consequently, the pivots 47 are used as a pivot point when the front linkage 41 and the rear linkage 42 are respectively simultaneously swung relative to the corresponding stud 30, and the upper linkage 43 and the lower linkage 44 are simultaneously moved opposite to each other. A first sliding jaw 51 and a second sliding jaw 52 are disposed between the two parallel link mechanisms 40 and correspond to each other. The first sliding jaw 51 and the second sliding jaw 52 respectively has a notch 53 defined in an inner side thereof. The first sliding jaw 51 has two opposite sides respectively secured to the lower linkage 44 of each of the two parallel link mechanisms 40 by a first locking member 511. The second sliding jaw 52 has two opposite sides respectively secured to the upper linkage 43 of each of the two parallel link mechanisms 40 by a second locking member 522. Each side of the first sliding jaw 51 and the second sliding jaw 52 has a guider 54 extending therefrom, wherein each guider 54 extends through the elongated groove 46 in a corresponding one of the two middle linkages 45 for guiding the first sliding jaw 51 and the second sliding jaw when being moved.

Figure 2:
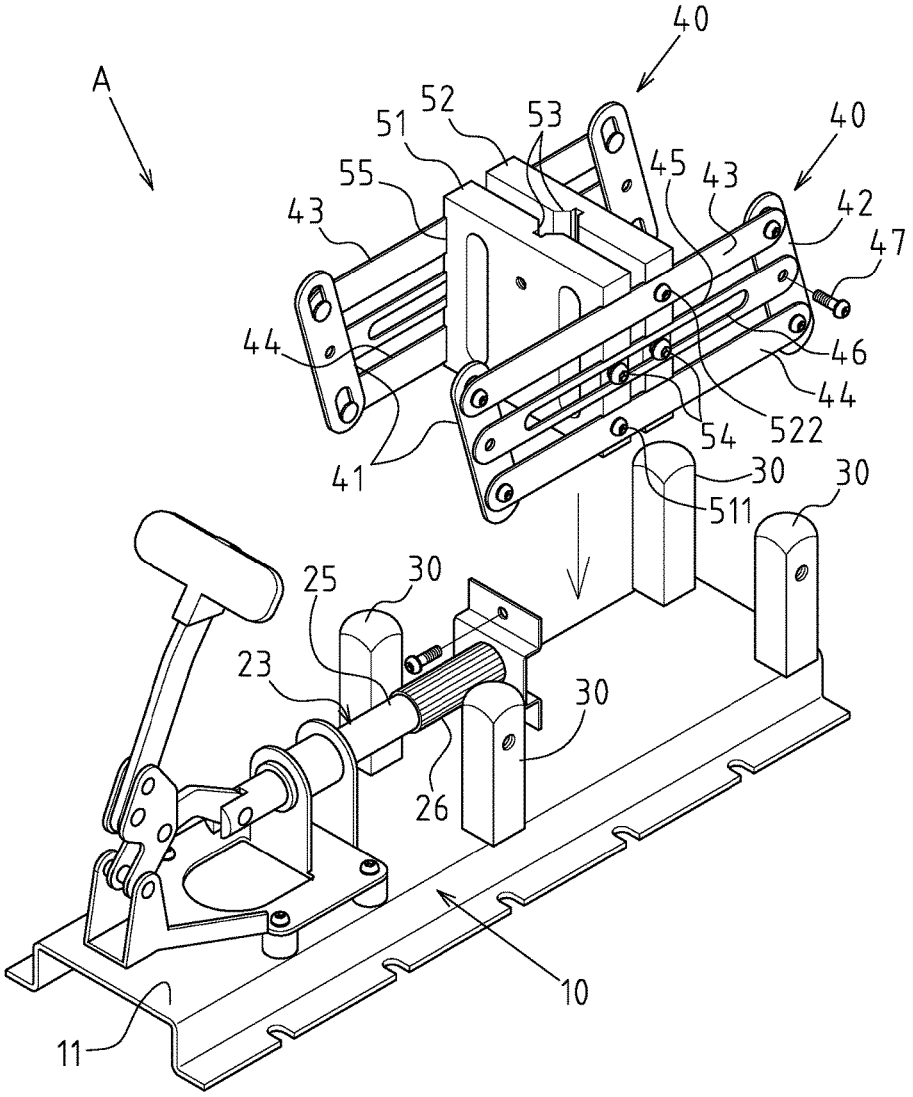
FIG. 2 is a partially perspective view of the pen vice in FIG. 1.
Figure 3:
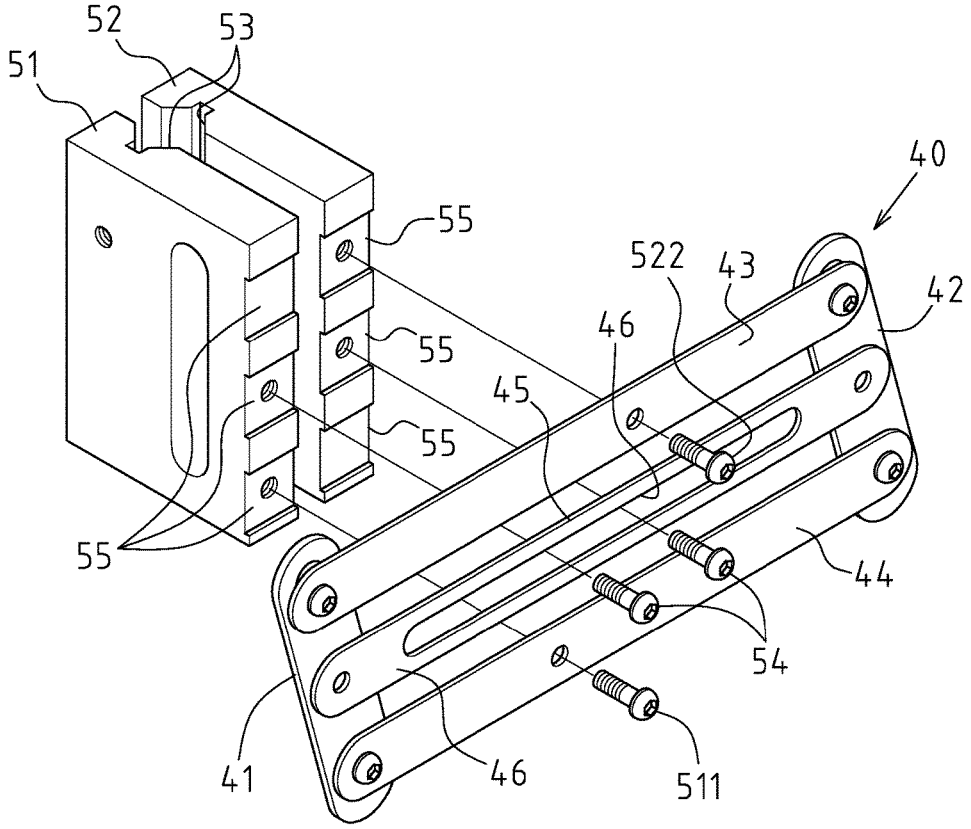
FIG. 3 is a partially perspective view of the pen vice in FIG. 1.

With reference to FIGS. 1 to 3, the upper linkage 43, the lower linkage 44, the front linkage 41, the rear linkage 42 and the middle linkage 45 of each of the two parallel link mechanisms 40 respectively have a plate-like structure.

Figure 4:
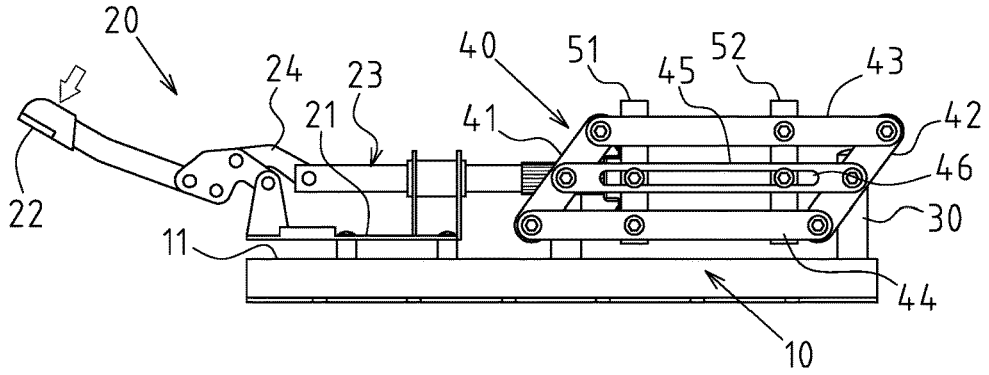
FIG. 4 is a first side operational view of the pen vice in accordance with the present invention.
Figure 5:
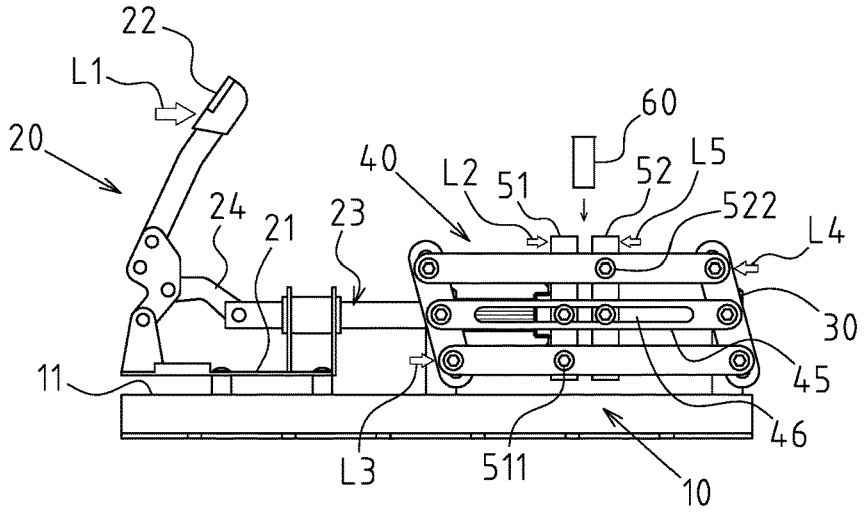
FIG. 5 is a second side operational view of the pen vice in accordance with the present invention.
Figure 6:
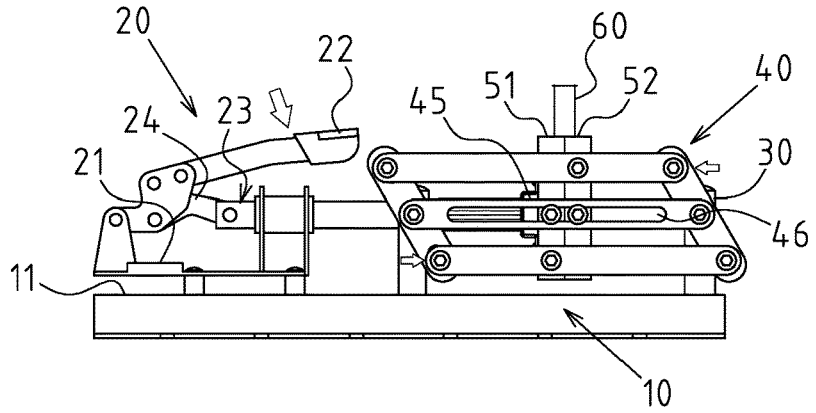
FIG. 6 is a third side operational view of the pen vice in accordance with the present invention.

With reference to FIGS. 4 to 6, in the preferred embodiment of the present invention, the horizontal height of the middle linkage 45 is the same as that of the shaft 23 for providing an excellent operating relation because the drive point of the first sliding jaw 51 corresponds to a free end of the shaft 23 and a center of each of the parallel link mechanisms 40 is situated on the middle linkage 45.

With reference to FIGS. 1 to 4, in the preferred embodiment of the present invention, the upper linkage 43, the lower linkage 44, the front linkage 41 and the rear linkage 42 of each of the parallel link mechanisms 40 form a parallel four link mechanism.

With reference to FIGS. 1 to 4, in the preferred embodiment of the present invention, the operating element 22 is a lever. A linkage 24 has two opposite ends respectively pivotally connected to the shaft 23 and the operating element 22. A fine tuning element 26 is disposed on the drive end 25 of the shaft 23.

As described above, when operating the pen vice A in accordance with the present invention, as shown in FIG. 4, the operating element 22 is outwardly wrenched for pull the shaft 23 such that the first sliding jaw 51 is moved opposite to the second sliding jaw 52. As a result, the first sliding jaw 51 and the second sliding jaw 52 are separated from each other. With reference to FIGS. 4 to 6, when the operator wants to clamp a pen shank 60, the pen shank 60 is previously disposed between the first sliding jaw 51 and the second sliding jaw 52. The operating element 22 is wrenched along the arrow L1, as shown in FIG. 5, for simultaneously pushing the shaft 23 with the first sliding jaw 51 and making the first sliding jaw 51 moved along the arrow L2. The first locking member 511 drive the lower linkage 44 to make the lower linkage 44 moved along the arrow L3 when the first sliding jaw 51 is moved along the arrow L2. The front linkage 41 and the rear linkage 42 drive the upper linkage 43 to make the upper linkage 43 moved along the arrow L4. Accordingly, the second sliding jaw 52 is moved along the arrow L5 for clamping the pen shank 60 with the first sliding jaw 51 moved along the arrow L2. As described above, the pen vice A in accordance with the present invention has the following advantages. The studs 30 vertically securely on the top surface 11 of the base 10 are cheap and can be mass-produced for meeting the economic benefit. In addition, the studs 30 provide an excellent structural strength and an excellent supporting rigidity. The studs 30 correspond to an inner side of each of the two parallel link mechanisms 40 such that the width of the pen vice A in accordance with the present invention is narrowed relative to the conventional pen vice in accordance with the prior art when the widths of the first sliding jaw 51 and the second sliding jaw 62 are fixed. Each side of the first sliding jaw 51 and the second sliding jaw 52 has a guider 54 secured thereon and extending through the elongated groove 46 in a corresponding one of the middle linkage 45 for providing a guiding relation. In addition, each side of the first sliding jaw 51 and the second sliding jaw 52 has multiple grooves 55 defined therein, wherein the upper linkage 43, the lower linkage 44 and the middle linkage 45 of each of the two parallel link mechanisms 40 is slidably received in a corresponding one of the grooves 55 for stably driving the first sliding jaw 51 and the second sliding jaw 52 and providing a stable operation to the pen vice A in accordance with the present invention.

Figure 10:
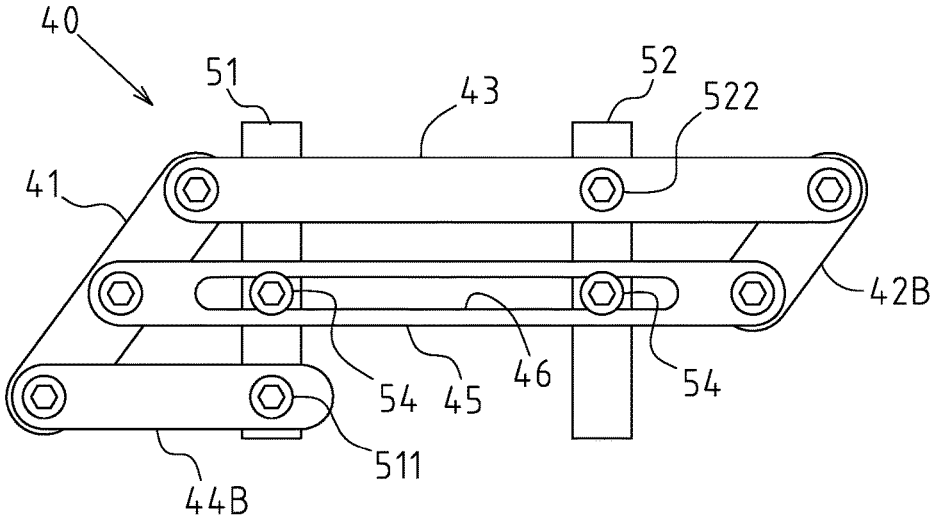
FIG. 10 is a side plan view of a second embodiment of the parallel link mechanism of the pen vice in accordance with the present invention.

With reference to FIG. 10, the upper linkage 43 and the lower linkage 44B of each of the two parallel link mechanisms 40 have a first end pivotally connected to two opposite ends of a corresponding one of the two front linkages 41. A second end of each of the two upper linkages 43 is pivotally connected to an upper end of a corresponding one of the two rear linkages 42B, wherein the rear linkage 42B has a second end pivotally connected to a rear end of a corresponding one of the two middle linkages 45. In the preferred embodiment of the present invention, the lower linkage 44B is separated from the rear linkage 42B.

With reference to FIGS. 1 to 4, the upper linkage 43 and the lower linkage 44 is inevitably moved up and down when reciprocally moved for driving the first sliding jaw 51 and the second sliding jaw 52. For providing a smooth operation, the grooves 55 have a width greater than that of the upper linkage 43 and the lower linkage 44. Furthermore, the pivot structures among the upper linkage 43, the lower linkage 44, the front linkage 41 and the rear linkage 42 is pivot and elongated hole when a width of the groove 55 is equal to that of the upper linkage 43 and the lower linkage 44.

The middle linkage 45 of each of the two parallel link mechanisms 40 is slidable received in a corresponding one of the grooves 55 in the first sliding jaw 51 and the second sliding jaw 52 for providing a guiding effect.

Figure 7:
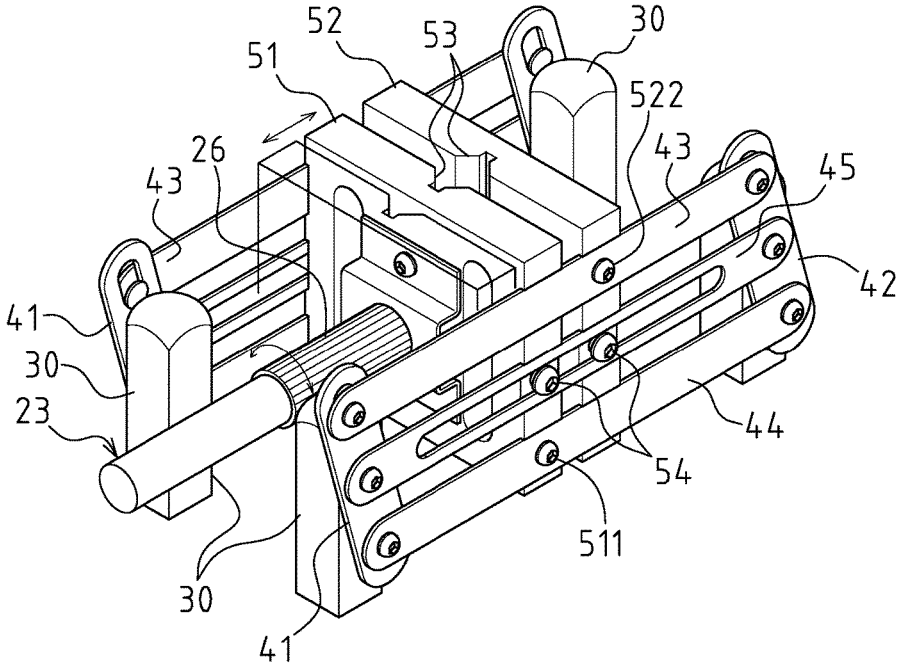
FIG. 7 is an operational view of the pen vice in accordance with the present invention when fine tuning the clamping distance between the sliding jaw and the stationary jaw.
Figure 8:
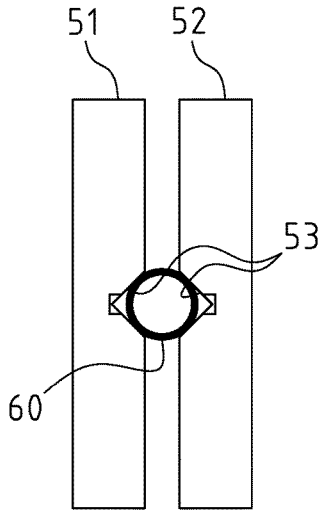
FIG. 8 is a first operational view of the sliding jaw and the stationary jaw.
Figure 9:
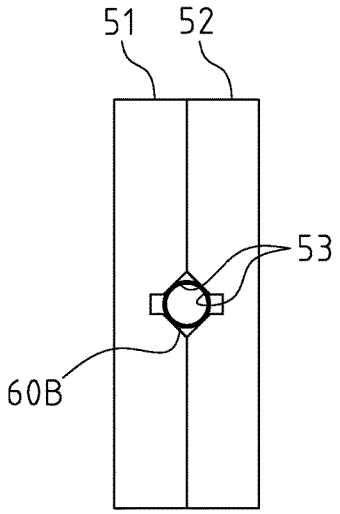
FIG. 9 is a first operational view of the sliding jaw and the stationary jaw.

With reference e to FIG. 7, the clamping pitch between the first sliding jaw 51 and the second sliding jaw 52 is adjusted by the fine tuning member 26 on the drive end 25 of the shaft 23 for different pen shanks 60/60B that have different diameters, as shown in FIGS. 8 and 9.

Although the invention has been explained in relation to its preferred embodiment, it is to be understood that many other possible modifications and variations can be made without departing from the spirit and scope of the invention as hereinafter claimed.

I claim:

1. A pen vice comprising:

a base formed with a top surface;

an operating device mounted onto a first end portion of the top surface, the operating device including a seat secured on the top surface, a shaft movably mounted onto the seat and an operating element pivotally mounted to the seat for reciprocally driving the shaft, wherein the shaft is formed with a drive end;

multiple studs vertically secured on a second end portion of the top surface and corresponding to two opposite sides of the base;

two parallel link mechanisms respectively mounted onto the studs that correspond to the two opposite sides of the base, each parallel link mechanism including an upper linkage and a lower linkage, wherein each upper linkage and lower linkage has a front end and a rear end, a front linkage having two opposite ends respectively pivotally connected to a front end of each of the upper linkage and the lower linkage, and a rear linkage having two opposite ends respectively pivotally connected to a rear end of each of the upper linkage and the lower linkage, a middle linkage having two opposite ends respectively pivotally connected to a middle portion of each of the front linkage and the rear linkage, wherein the middle linkage is parallel to the upper linkage and the lower linkage, the middle linkage having an elongated groove longitudinally defined therein, the middle portion of the front linkage and the rear linkage, and two opposite ends of the middle linkage pivotally mounted to a corresponding one of the multiple studs, wherein the pivots are used as a pivot point when the front linkage and the rear linkage are respectively simultaneously swung relative to the corresponding stud, and the upper linkage and the lower linkage are simultaneously moved opposite to each other; and a first sliding jaw and a second sliding jaw disposed between the two parallel link mechanisms and corresponding to each other, the first sliding jaw and the second sliding jaw respectively having a notch defined in an inner side thereof, the first sliding jaw has two opposite sides respectively secured to the lower linkage of each of the two parallel link mechanisms by a first locking member, the second sliding jaw having two opposite sides respectively secured to the upper linkage of each of the two parallel link mechanisms by a second locking member, each side of the first sliding jaw and the second sliding jaw having a guider extending therefrom, wherein each guider extends through the elongated groove in a corresponding one of the two middle linkages for guiding the first sliding jaw and the second sliding jaw when being moved.

2. The pen vice as claimed in claim 1, wherein the upper linkage, the lower linkage, the front linkage, the rear linkage and the middle linkage of each of the two parallel link mechanisms respectively have a plate-like structure.

3. The pen vice as claimed in claim 2, wherein a horizontal height of the middle linkage is the same as that of the shaft for providing an excellent operating relation because the drive point of the first sliding jaw corresponds to a free end of the shaft and a center of each of the parallel link mechanisms is situated on the middle linkage.

4. The pen vice as claimed in claim 3, wherein the upper linkage, the lower linkage, the front linkage and the rear linkage of each of the parallel link mechanisms 40 form a parallel four link mechanism.

5. The pen vice as claimed in claim 3, wherein the upper linkage and the lower linkage of each of the two parallel link mechanisms have a first end pivotally connected to two opposite ends of a corresponding one of the two front linkages, a second end of each of the two upper linkages pivotally connected to an upper end of a corresponding one of the two rear linkages, wherein the rear linkage has a second end pivotally connected to a rear end of a corresponding one of the two middle linkages and the lower linkage is separated from the rear linkage.

6. The pen vice as claimed in claim 4, wherein the operating element is a lever, a linkage has two opposite ends respectively pivotally connected to the shaft and the operating element and a fine tuning element is disposed on the drive end of the shaft.

7. The pen vice as claimed in claim 5, wherein the operating element is a lever, a linkage has two opposite ends respectively pivotally connected to the shaft and the operating element and a fine tuning element is disposed on the drive end of the shaft.

8. The pen vice as claimed in claim 4, wherein each side of the first sliding jaw and the second sliding jaw has multiple grooves defined therein and the middle linkage of each of the two parallel link mechanisms is slidable received in a corresponding one of the grooves in the first sliding jaw and the second sliding jaw for providing a guiding effect.

9. The pen vice as claimed in claim 4, wherein each side of the first sliding jaw and the second sliding jaw has multiple grooves defined therein, and the upper linkage, the lower linkage and the middle linkage of each of the two parallel link mechanisms is slidably received in a corresponding one of the grooves for stably driving the first sliding jaw and the second sliding jaw and providing a stable operation to the pen vice, the grooves having a width greater than that of the upper linkage and the lower linkage.

10. The pen vice as claimed in claim 4, wherein each side of the first sliding jaw and the second sliding jaw has multiple grooves defined therein, and the upper linkage, the lower linkage and the middle linkage of each of the two parallel link mechanisms is slidably received in a corresponding one of the grooves for stably driving the first sliding jaw and the second sliding jaw and providing a stable operation to the pen vice, wherein pivot structures among the upper linkage, the lower linkage, the front linkage and the rear linkage is pivot and elongated hole when a width of the groove is equal to that of the upper linkage and the lower linkage.

* * * * *